US011358397B2

(12) United States Patent
Jin

(10) Patent No.: US 11,358,397 B2
(45) Date of Patent: Jun. 14, 2022

(54) DIGITAL DOUBLE-SIDED PRINTING MACHINE WITH SMOOTH HELICAL PRINTING TRAJECTORY

(71) Applicant: Samuel Zhihui Jin, Eastvale, CA (US)

(72) Inventor: Samuel Zhihui Jin, Eastvale, CA (US)

( * ) Notice: Subject to any disclaimer, the term of this patent is extended or adjusted under 35 U.S.C. 154(b) by 0 days.

(21) Appl. No.: 16/828,861

(22) Filed: Mar. 24, 2020

(65) Prior Publication Data

US 2022/0032655 A1 Feb. 3, 2022

(51) Int. Cl.

| | |
|---|---|
| ***B41J 3/407*** | (2006.01) |
| ***B41J 3/60*** | (2006.01) |
| ***B41J 2/01*** | (2006.01) |
| ***B41J 11/04*** | (2006.01) |
| ***B41J 13/16*** | (2006.01) |
| ***B41J 13/18*** | (2006.01) |
| ***B41J 13/22*** | (2006.01) |
| ***B41J 11/00*** | (2006.01) |

(52) U.S. Cl.

CPC ..... *B41J 3/4078* (2013.01); *B41J 2/01* (2013.01); *B41J 3/60* (2013.01); *B41J 11/00214* (2021.01); *B41J 11/04* (2013.01); *B41J 13/16* (2013.01); *B41J 13/18* (2013.01)

(58) Field of Classification Search

CPC ..... B41J 3/4078; B41J 3/60; B41J 2/01; B41J 11/04; B41J 13/16; B41J 13/18; B41J 13/223

See application file for complete search history.

(56) References Cited

U.S. PATENT DOCUMENTS

| | | | | |
|---|---|---|---|---|
| 6,095,628 | A | 8/2000 | Rhome | |
| 7,607,745 | B2 | 10/2009 | Ben-Zur | |
| 10,131,143 | B2 | 11/2018 | Snir et al. | |
| 2011/0025807 | A1 * | 2/2011 | Fukui | B41J 13/226 347/104 |
| 2017/0239961 | A1 | 8/2017 | Turner | |

FOREIGN PATENT DOCUMENTS

| | | | | |
|---|---|---|---|---|
| JP | 2001088989 A | * | 4/2001 | B41J 2/16508 |
| JP | 2011062988 A | * | 3/2011 | |
| JP | 2016108699 A | * | 6/2016 | |

* cited by examiner

*Primary Examiner* — Matthew Luu
*Assistant Examiner* — Kendrick X Liu
(74) *Attorney, Agent, or Firm* — X. Daniel Fang

(57) ABSTRACT

A digital printing machine comprises a cylindrical drum assembly on the rigid printing framework. A cylindrical drum moves along and rotates about its central cylindrical axis and a stationary printing head with multiple nozzles placed proximately above the circumference of the cylindrical drum. The combined linear and rotational movements of the cylindrical drum enable the printing head to create a smooth helical printing trajectory on the flexible fabrics. The cylindrical drum of the digital printing machine also works as a working drum to hold a piece of flexible textile to be printed. A double-side printing mechanism allows the digital printing machine to automatically carry out the second side printing.

6 Claims, 8 Drawing Sheets

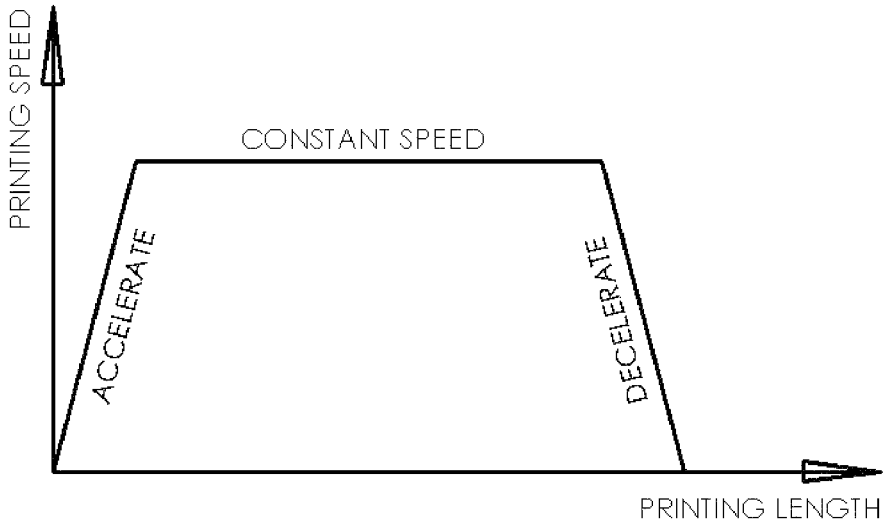
FIG. 1a
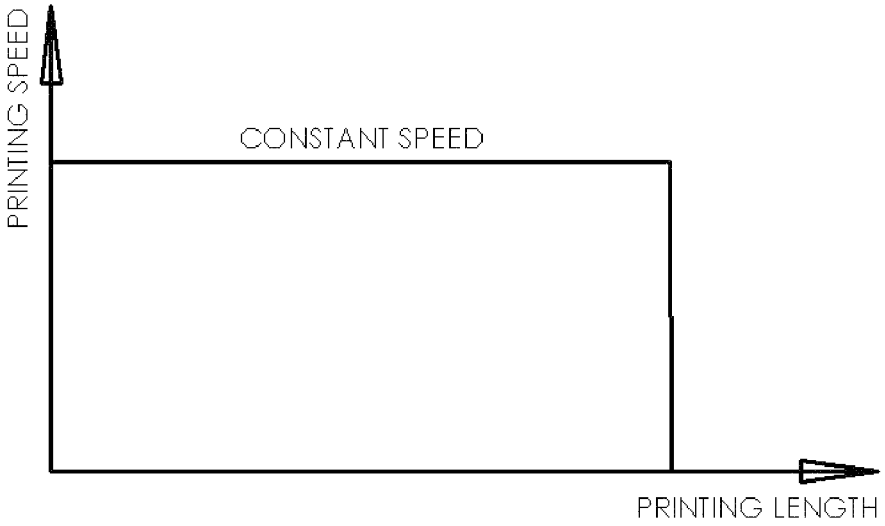
FIG. 1b
FIG. 1

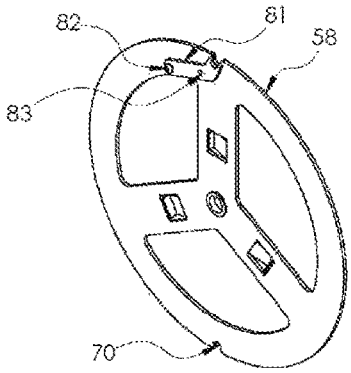
FIG. 6a
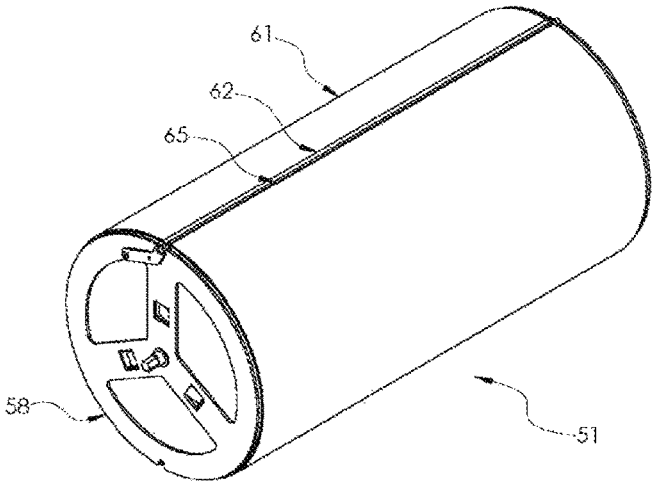
FIG. 6b
FIG. 6

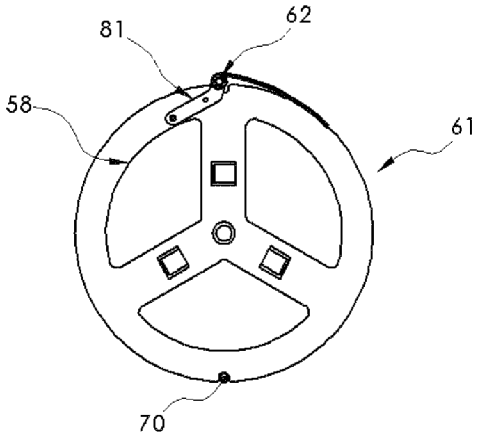
FIG. 7a
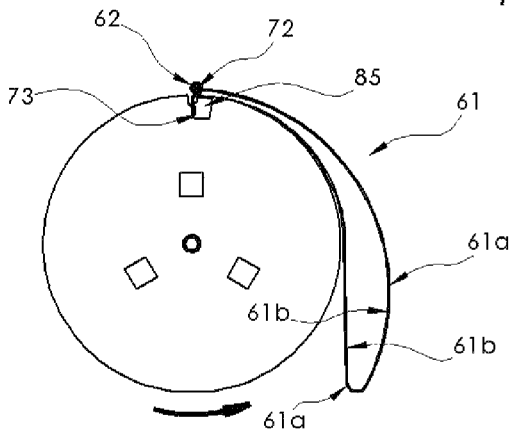
FIG. 7b
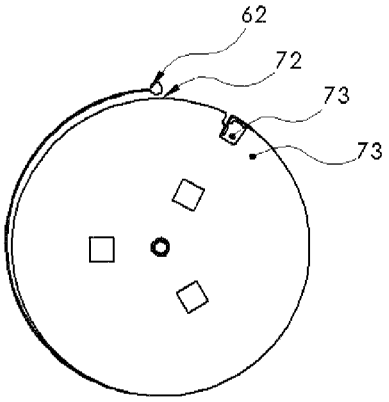
FIG. 7c
FIG. 7

DIGITAL DOUBLE-SIDED PRINTING MACHINE WITH SMOOTH HELICAL PRINTING TRAJECTORY

FIELD OF THE DISCLOSURE

In general, the invention relates to digital printing machines for printing a flexible work piece, such as textile, fabric, garment, or T-shirt, etc., and more particularly, to a unique digital printing machine that is featured by a drum-based structure, a stationary printing head, a synchronized drum rotating movement and a linear movement for creating a helical printing trajectory, and a mechanism of single and/or double-sided printing of a flexible work piece.

BACKGROUND OF THE DISCLOSURE

From the point of view of printing movements, there are basically two types of digital printing machines for ink printing a flexible work piece.

The first type is an X-Y linear coordinating platform with the X-axis controlling the horizontal linear movement of a printing head and the Y-axis controlling the vertical linear movement of a printing table where a flexible work piece is attached. Representative prior arts include U.S. Pat. Nos. 6,095,628 and 7,607,745. The common disadvantage of an X-Y coordinating platform-based digital printing machines is that the ink printing head has to travel in a high speed along the X-axis with left and right reciprocal motions. In addition, the ink printing head does not work efficiently as it has to decelerate when approaching to one end (left or right) and accelerate when departing from that end.

The second type is a combined linear and rotational mechanism where a drum wrapped with a flexible work piece rotates about its own axis while a printing head placed on the top of the drum moves reciprocally parallel to the drum axis. Representative prior arts include U.S. Pat. No. 10,131,143 and United Patent Application Publication 2017/0239961. Even though the above two inventions may benefit from a configuration of the printing machine with a rotatory drum, such as the former can print pictures on seamless textiles that are fitted on a rotating drum and the latter can print pictures on the entire external side of a textile embraced on a rotary drum, they also have the common disadvantage of an X-Y coordinating platform-based digital printing machines simply due to the high-speed reciprocal movement of the printing head.

To overcome the common disadvantage of the prior art digital printing machines as above-described, the present invention presents an innovative digital printing machine having a stationary printing head when printing and a drum with synchronized control of a drum rotation and a linear motion along the drum axis for a smooth helical printing trajectory.

SUMMARY OF THE INVENTION

The embodiments as presented in this invention may relate to a digital printing machine for printing a flexible work piece that is featured by a cylindrical drum moving in a linear direction along its central axis and synchronously rotating about its central axis. The greatest advantage of having a stationary ink printing head is the constant printing speed without left to right (or right to left) reciprocal motions.

FIG. 1(*a*) shows the relationship of the printing speed vs. the printing length for the prior art digital printing machines having a reciprocal printing head movement. While as a comparison, FIG. 1(*b*) shows the relationship of the printing speed vs. the printing length for the present invention having a stationary printing head movement.

According to one embodiment of this invention, with both the drum rotary movement and the drum linear movement being seamlessly and synchronously controlled by a drive control system of the digital printing system, the printer continuously and smoothly prints a helical trajectory on a flexible work piece attached on the same drum.

According to another embodiment of this invention, the cylindrical drum comprises a longitudinal open slot parallel to the drum axis and a clamp bar to lock a flexible work piece onto the drum. After the first side (or front side) of a flexible work piece completes the printing, the clamp bar lifts the clamped flexible work piece a little bit, and allows the drum rotating reversely until the second side (or the back side) of the flexible work piece is exposed and wrapped on the drum. If there is a need for a second side printing, the flexible work piece may be secured again by the clamp bar, then a new printing operation may start.

BRIEF DESCRIPTION OF THE DRAWINGS

FIG. 1 is a comparison of the relationship of the printing speed vs. the printing length between the prior arts and the present invention with FIG. 1*a* for the prior art and FIG. 1*b* for the present invention.

FIG. 6 demonstrates the mechanism of double-sided printing on a flexible work piece with FIG. 6*a* for a solenoid magnet on a side plate and FIG. 6*b* for the two side plates being disconnected from the drum and locked in a fixed position.

FIG. 7 further demonstrates the mechanism of double-sided printing on a flexible work piece with FIG. 7*a* demonstrating a clamp bar holding the end of the work piece; FIG. 7*b* showing the other end of the work piece being secured by a flat bar; and FIG. 7*c* illustrating when the drum almost completes the second reverse turn.

DETAILED DESCRIPTION OF THE INVENTION

The present invention is related to a digital printing machine for printing various kinds of flexible work pieces (textiles, garments, fabrics, etc.) with different shapes (rectangle, pants, T-shirts, knitted vest, etc.). The digital printing machine is featured by a stationary ink printing head that will eliminate many problems caused by the conventional digital printing machines with a high-speed reciprocal movement of the printing head.

A unique cylindrical drum is constructed featuring a synchronized drive control for a linear movement along the drum central axis and a rotary movement about its central axis thus to result in a precisely controlled helical trajectory for any point on the drum periphery. The combined stationary ink printing head and synchronous drum helical movements seamlessly work together to produce a smooth and stable printing trajectory on a flexible work piece, providing a printed flexible work piece with better quality and reduced cost. Furthermore, the present invention presents a new mechanism to provide the capability of double-sided (front and back) printing for a flexible work piece with only one load operation.

Figure 2:
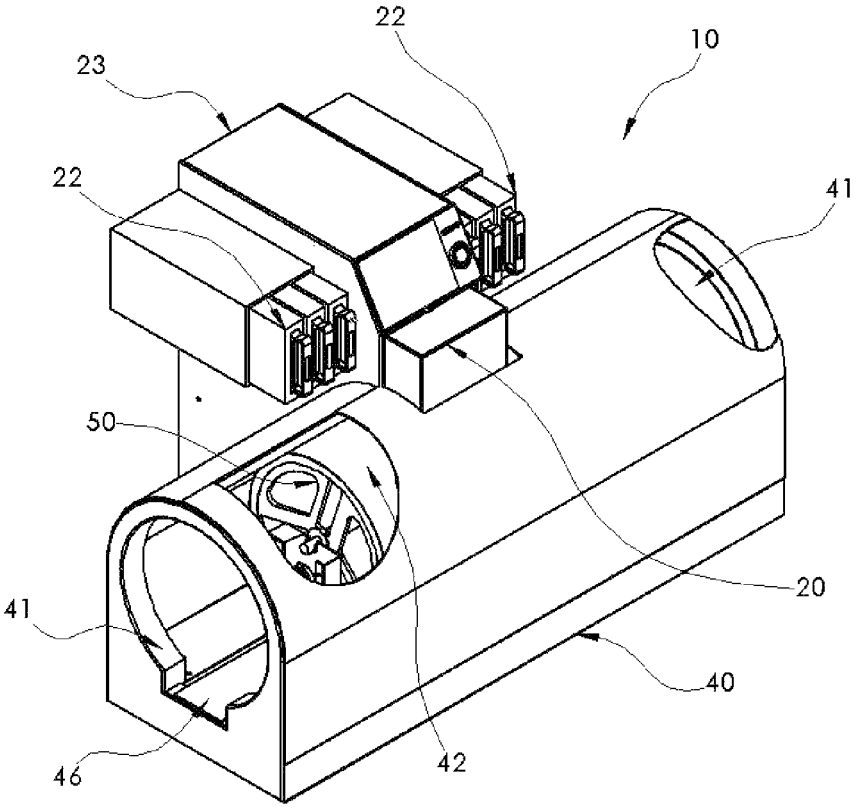
FIG. 2 is an overview of an embodiment of the digital printing machine according to the present invention.

Referring to FIG. 2 for an embodiment according to the present invention, the digital printing machine 10 comprises an ink printing head 20 mounting on a control tower 23 and ink cartridges 22, a work center 40 with two openings 41. The working center 40 houses a cylindrical drum assembly 50 where a flexible work piece or a T-shirt 42 as shown. The drum assembly 50 travels on the rail 46 inside the work center 40 and performs the first linear movement along the drum central axis and the second rotary movement about the drum central axis. The first linear movement does not have a reciprocal pattern rather than it is a single pass from left to right (or from right to left) for each side printing of a flexible work piece. There are arrays of print-head nozzles 25 (not shown) aligned parallelly to the central axis of the cylindrical drum.

Figure 3:
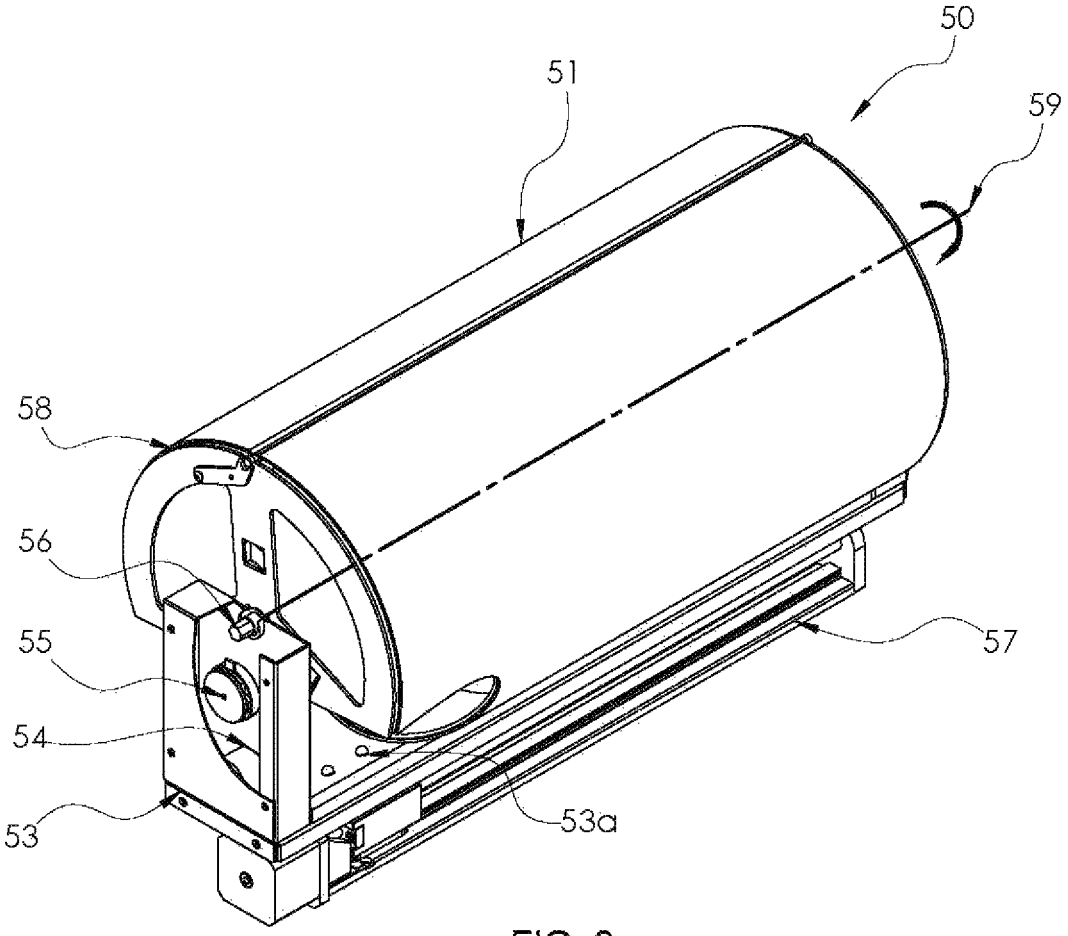
FIG. 3 is a perspective view of the drum assembly.

Referring to FIG. 3 for an embodiment of the drum assembly 50 according to the present invention, the drum assembly 50 comprises a cylindrical drum 51 with a central axis 59, two side plates 58 on each side to be attached to the drum 51, a linear moving unit 57, a driving mechanism unit 53 comprising a motor 55 with its output shaft 56 driving the drum 51 to rotate about its central axis 59, a linear motor driven mechanism 52 driving the moving unit 57 along the drum central axis 59, and a solenoid lock 54 for controlling the side plates 58 on or off from the drum 51. The driving mechanism unit 53 further comprises a UV ink curing LED lights 53*a*. During the printing process, the drum 51 will constantly rotate clockwise (as viewed from the left), and synchronously moves linearly along the central axis 59.

Figure 4:
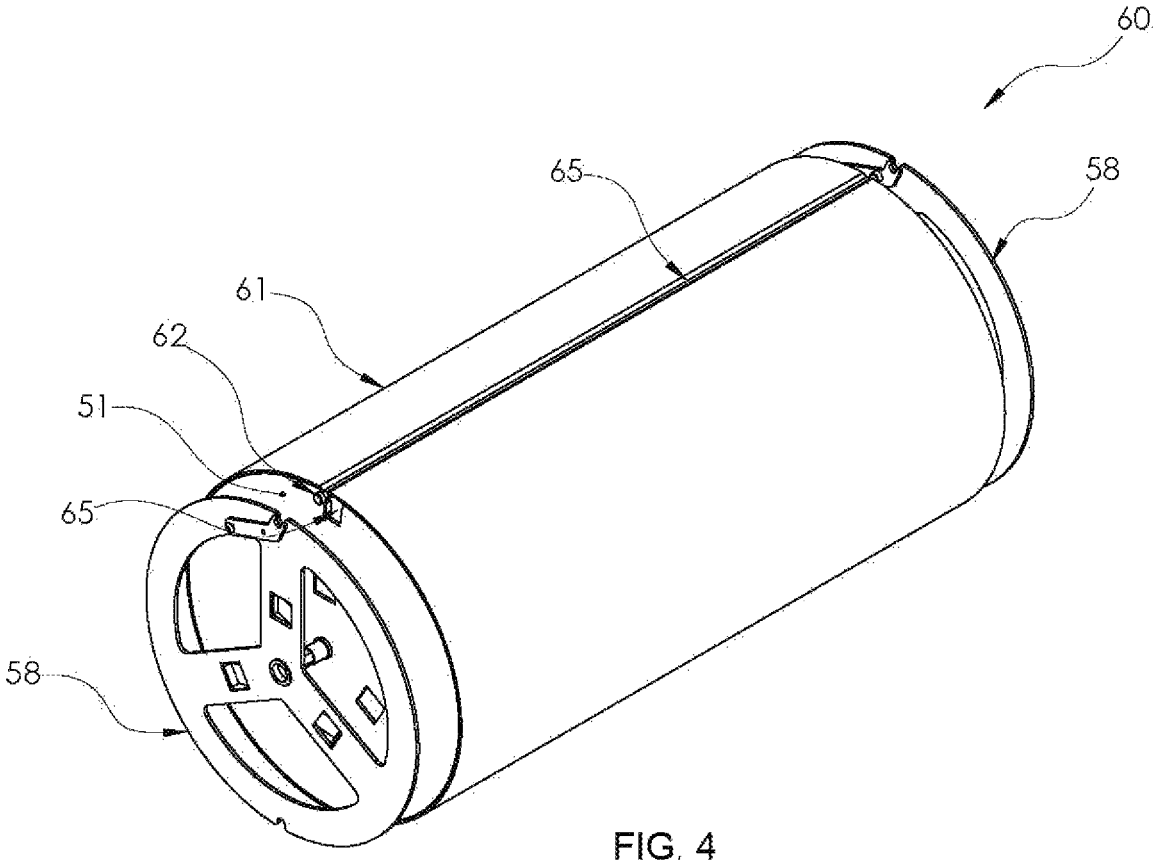
FIG. 4 is a perspective view of a partial drum assembly.

FIG. 4 shows a perspective view of a partial drum assembly 60 comprising the drum 51 with a rectangular flexible work piece 61 wrapped on it, an open longitudinal slot 65, a pair of clamp bars 62 for securing the work piece 61 inside the open slot 65.

Figure 5:
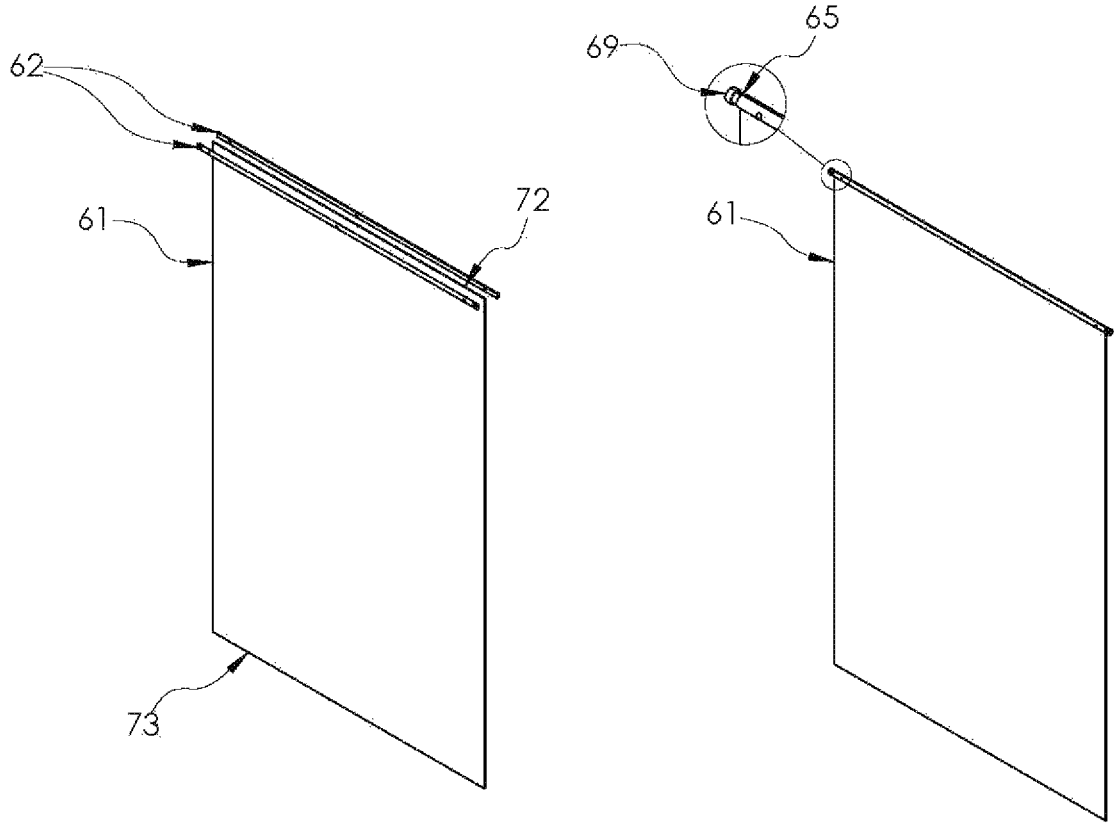
FIG. 5 demonstrates how a flexible work piece is attached to a clamp bar.

Referring to FIG. 5 for a perspective view, a demonstration is provided how one end 72 of the flexible work piece 61 is secured by a pair of clamp bars 62 and a clamp cap 69 (only shown at one end of the clamp bar 62). The other end 73 of the flexible work piece 61 is to be secured into the open slot 65.

FIG. 6 and FIG. 7 together demonstrate the mechanism of double-sided printing on a flexible work piece 61. When there is a need for printing the other side of the flexible work piece 61, the following procedure will be carried out:

(1) the drum 51 stops at a default position;

(2) the solenoid magnets 70 (on both side of the drum 51) are activated to disconnect the two side plates 58 from the drum 51 and lock them in a fixed position;

(3) the drum 51 starts to rotates reversely (i.e. counter clockwise as viewed from left) and the two support arms 81 (on both side of the drum 51) lift the clamp bar 62 up a little bit and hold it in a fixed position, wherein each support arm 81 rotates around a pilot pin 82 and a torsion spring 83 connects a support arm 81 and the pilot pin 82;

(4) with the clamp bar 62 holding the end 72 of the work piece 61 as shown in FIG. 7(*a*) and the other end 73 of the work piece 61 being secured inside the slot 65 by a flat bar 85 as shown in FIG. 7(*b*), the drum continues to reversely rotate after one turn at the position given in FIG. 7(*b*), a part of the printed side (first side) 61*a* of the work piece 61 is still facing outward while some of the unprinted side (second side) 61*b* of the work piece 61 is about to face outward;

(5) when the drum 51 almost completes the second reverse turn as shown in FIG. 7(*c*), the unprinted side 61*b* of the work piece 61 is all facing outward;

(6) then the solenoid magnets 70 are activated to reconnect the two side plates 58 back to the drum 51 and the support arm 81 is also reversely activated to lock the clamp bar 62 back into the slot 65; and (7) the unprinted second side (or back side) 61*b* of the flexible work piece 61 is ready for printing.

Figure 8:
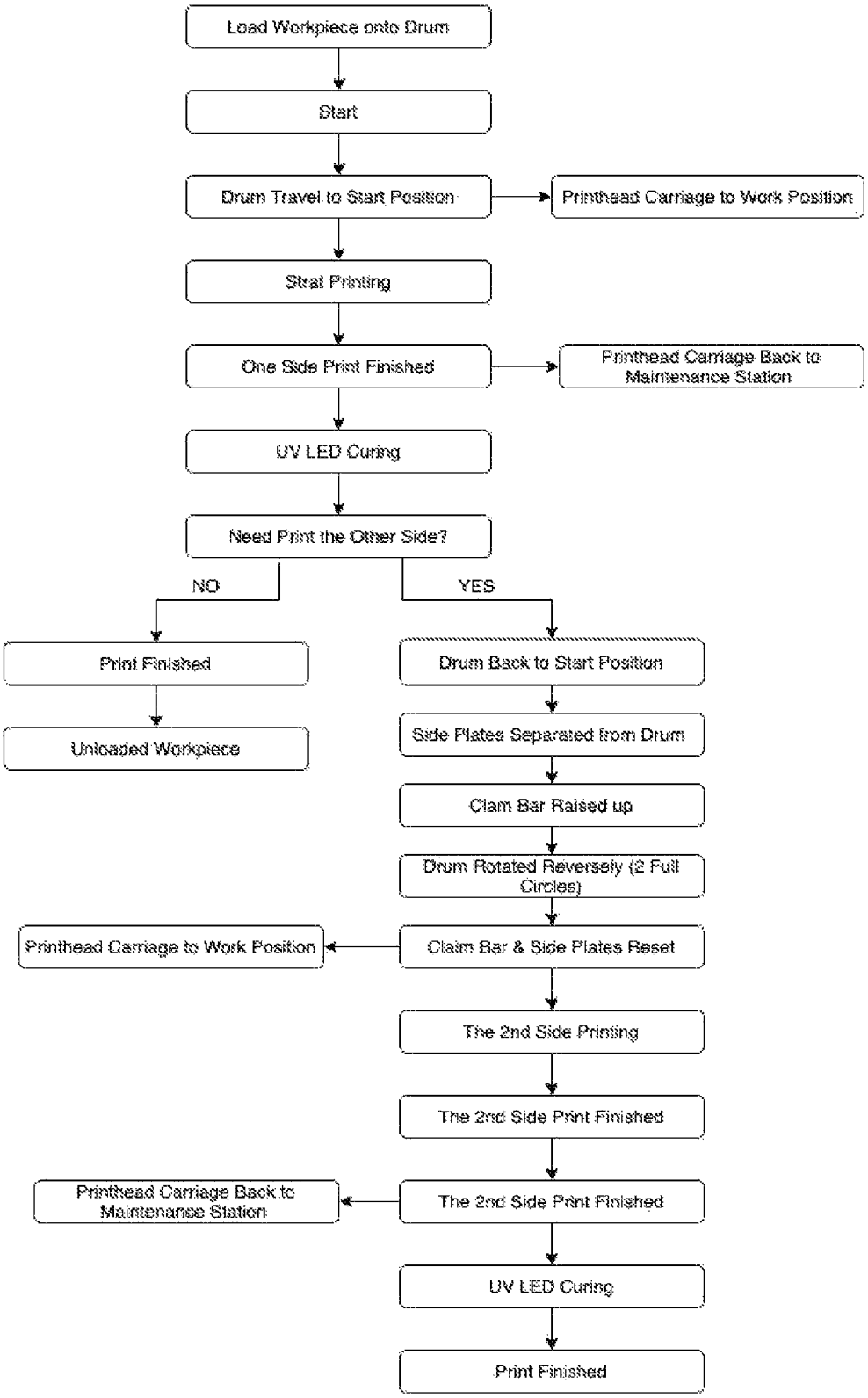
FIG. 8 is a workflow chart showing the entire printing process.

FIG. 8 illustrates a workflow chart showing the entire printing process including a single-sided printing operation and a double-sided printing operation.

Each of the patents and other documents identified herein are hereby incorporated in their entirety by reference herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Other embodiments of the present invention will be apparent to those skilled in the art from a consideration of the specification or a practice of the invention disclosed herein. It is intended that the specification and examples are illustrative only and are not intended to be limiting on the scope of the invention. The true scope and spirit of the present invention is indicated by the following claims.

What is claimed is:

1. A digital printing machine for printing flexible textiles comprising:

a digital printing framework;

a cylindrical drum assembly mounted on the framework and the cylindrical drum assembly comprising a cylindrical drum;

a printing head comprising an array of nozzles aligned parallel to the central axis of the cylindrical drum;

wherein the printing head is stationary when printing;

wherein the cylindrical drum assembly moves in a linear direction along its central axis and synchronously rotates about its central axis; and wherein the cylindrical drum assembly comprises a cylindrical drum with a longitudinal slot on its peripheral surface, two side plates with each having a support arm, a clamp bar for securing a flexible work piece.

2. The digital printing machine of claim 1, wherein any point on the periphery of the cylindrical drum follows a smooth helical trajectory.

3. The digital printing machine of claim 1, wherein each of the nozzles prints a smooth helical line of paint on a flexible work piece during the entire printing operation.

4. The digital printing machine of claim 1, wherein the longitudinal slot and the clamp bar secure a piece of flexible textile on the peripheral surface of the cylindrical drum.

5. A digital printing machine for printing flexible textiles comprising:

a digital printing framework;

a cylindrical drum mounted on the framework;

a printing head comprising an array of nozzles aligned parallel to the central axis of the cylindrical drum;

wherein the printing head is stationary when printing;

wherein the cylindrical drum comprises a first linear movement parallel to and along its central axis and a second rotational movement rotating about its central axis; and wherein the first linear movement and the second rotational movement are seamlessly synchronized to form a smooth helical printing trajectory for any and every point printed on a flexible work piece attached on the peripheral surface of the cylindrical drum.

6. A digital printing machine for double-sided printing flexible textiles comprising:

a digital printing framework;

a cylindrical drum assembly mounted on the framework and the cylindrical drum assembly comprising a cylindrical drum wherein the cylindrical drum comprises a first linear movement parallel to and along its central axis and a second rotational movement rotating about its central axis;

a printing head comprising an array of nozzles aligned parallel to the central axis of the cylindrical drum wherein the printing head is stationary when printing; and wherein the cylindrical drum assembly comprises an automatic double-sided printing mechanism comprising a cylindrical drum holding a flexible work piece secured by a clamp bar, a pair of side plates, a support arm on each side plate, and a solenoid trigger unit, and the double-sided print comprising a first side printing and a second side printing, wherein once the first-side printing is completed, the double-sided printing mechanism triggers the side plates to disconnect from the cylindrical drum, the support arms to lift the clamp bar, the cylindrical drum to reversely rotate two turns to flip over the flexible work piece, and then reconnect the side plates back to the cylindrical drum ready for the second-side printing.

* * * * *